US009039099B2

(12) United States Patent
Sollami

(10) Patent No.: US 9,039,099 B2
(45) Date of Patent: May 26, 2015

(54) COMBINATION POLYCRYSTALLINE DIAMOND BIT AND BIT HOLDER

(71) Applicant: Phillip Sollami, Herrin, IL (US)

(72) Inventor: Phillip Sollami, Herrin, IL (US)

( * ) Notice: Subject to any disclaimer, the term of this patent is extended or adjusted under 35 U.S.C. 154(b) by 0 days.

(21) Appl. No.: 13/801,012

(22) Filed: Mar. 13, 2013

(65) Prior Publication Data

US 2014/0110991 A1 Apr. 24, 2014

Related U.S. Application Data

(60) Provisional application No. 61/716,243, filed on Oct. 19, 2012.

(51) Int. Cl.

| | |
|---|---|
| ***E21C 35/19*** | (2006.01) |
| ***E21C 35/18*** | (2006.01) |
| ***E21C 35/183*** | (2006.01) |
| ***E21C 35/197*** | (2006.01) |
| ***B28D 1/18*** | (2006.01) |

(52) U.S. Cl.

CPC ..... *E21C 35/18* (2013.01); *E21C 35/183* (2013.01); *E21C 35/197* (2013.01); *B28D 1/188* (2013.01)

(58) Field of Classification Search

CPC ..... E21C 2035/1816; E21C 35/183
USPC ..... 299/111, 113
See application file for complete search history.

(56) References Cited

U.S. PATENT DOCUMENTS

| | | | | |
|---|---|---|---|---|
| 4,084,856 | A * | 4/1978 | Emmerich et al. | 299/104 |
| 6,102,486 | A * | 8/2000 | Briese | 299/111 |
| 6,739,327 | B2 * | 5/2004 | Sollami | 125/36 |
| 6,846,045 | B2 * | 1/2005 | Sollami | 299/105 |
| 7,210,744 | B2 * | 5/2007 | Montgomery, Jr. | 299/104 |

FOREIGN PATENT DOCUMENTS

| | | | |
|---|---|---|---|
| GB | 2483157 | * | 2/2012 |

* cited by examiner

*Primary Examiner* — John Kreck
(74) *Attorney, Agent, or Firm* — Patnaude & Videbeck

(57) ABSTRACT

A quick change type bit/bit holder includes several different structures for holding the item in a bit block without the necessity of a fastener. The bit portion of the bit/bit holder combination includes a ductile steel insert with a polycrystalline diamond coated tungsten carbide bit positioned therein. The ductility of the steel insert acts as a shock absorber to allow the bit to successfully remove concrete as well as asphalt in a road milling machine.

6 Claims, 4 Drawing Sheets

COMBINATION POLYCRYSTALLINE DIAMOND BIT AND BIT HOLDER

This application claims priority to and is a continuation-in-part of provisional patent application Ser. No. 61/716,243 filed Oct. 19, 2012 to the extent allowed by law.

This invention relates generally to an integrally formed road milling bit and bit holders for mounting on road milling and other machines and, more particularly, to combinations of bit and bit holders having a polycrystalline diamond cutting tools as a forward leading tip of each.

BACKGROUND OF THE INVENTION

Originally, road milling equipment was utilized to smooth out bumps in the surface of a roadway or grind down the joinder of two adjacent concrete slabs that may have buckled. However, later these road milling machines, operated with a cylindrical drum having a plurality of bit blocks mounted thereon in herringbone or spiral fashion, and bit holders with bits on top thereof in turn mounted on the bit blocks, have been utilized for completely degrading concrete and macadam roads down to their gravel base. The apparatus can also be used for trenching and mining operations.

Bits such as those shown in U.S. Pat. No. 6,739,327 disclose an insert having a conical cutting tip that is mounted in a recess in a frustoconical forward portion of the bit. The insert 88 is surrounded by a hardened annular collar that provides added wear resistance to the cutting tool. The tool has a solid generally cylindrical shank extending axially rearwardly from the body portion.

The bit as described in the U.S. Pat. No. 6,739,327 fits in a central bore in a bit holder as described in U.S. Pat. Nos. 6,371,567 and 6,585,326. The above-described bit holders, being frictionally seated in bores in their respective bit blocks mounted on drums, and not held therein by retaining clips or threaded nuts provide for ease of removal and replacement when the bit holders are worn through use, or broken because of the harsh road degrading environment they are used in.

Additionally, it has been found that because of the harsh use environment, individual bits may wear or be broken off of their shanks and need replacement. Historically, these bits and bit holders have been made of steel with hardened tungsten carbide tips or collars to lengthen their end use service time.

Recently, the use of materials harder than tungsten carbide, i.e., polycrystalline diamond, such as shown in U.S. Pat. No. 8,118,371 has been used in certain road milling operations, notably the degradation of asphalt layers on long roadway stretches. While the hardness of the polycrystalline diamond tip lengthens the useful life of the combined bit and bit holder shown in the '371 patent, such that the bit does not have to be removable from the bit holder, the combination includes a somewhat brittle polycrystalline diamond tip that is not suitable for use in degrading concrete highways, or curved highway stretches such as cloverleafs and the like.

A need has developed for the provision of a polycrystalline diamond structured combination bit and bit holder that is sturdy enough to withstand the forces found when degrading or breaking up the surfaces of not only macadam (asphalt) roadways but also concrete roadways.

SUMMARY OF THE INVENTION

The invention resides a bit holder for road milling machinery, a shank comprising an elongate generally cylindrical member having a distal end including an annular axially inwardly extending groove therein defining an interior surface of an annular outer side wall between about ⅛ and ½ inch in thickness.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings wherein like numerals refer to like parts, and in which:

DETAILED DESCRIPTION OF THE PREFERRED EMBODIMENT

Figure 1:
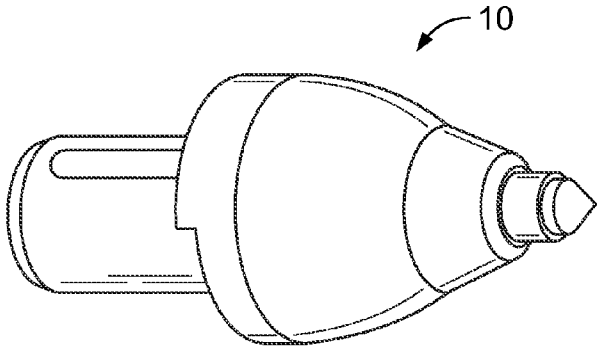
FIG. 1 is a front ¼ perspective view of a first embodiment combination bit and bit holder including a conical polycrystalline diamond tip thereof constructed in accordance with the present invention.
Figure 2:
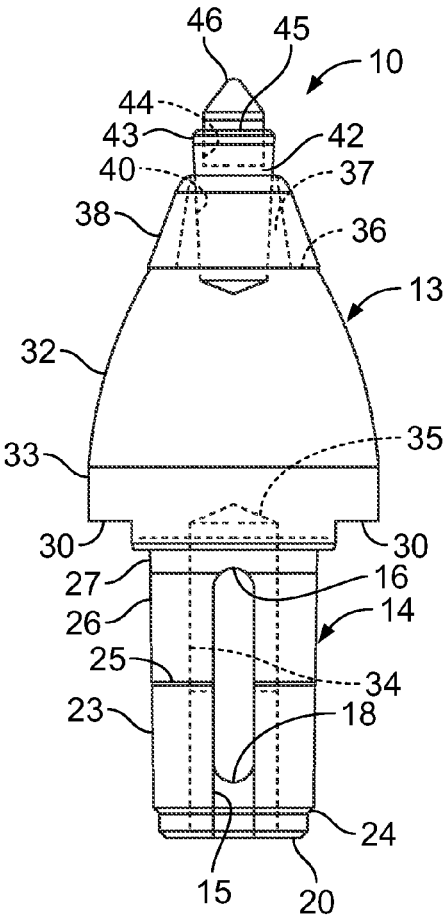
FIG. 2 is a front elevational view of the combination bit and bit holder shown in FIG. 1.
Figure 3:
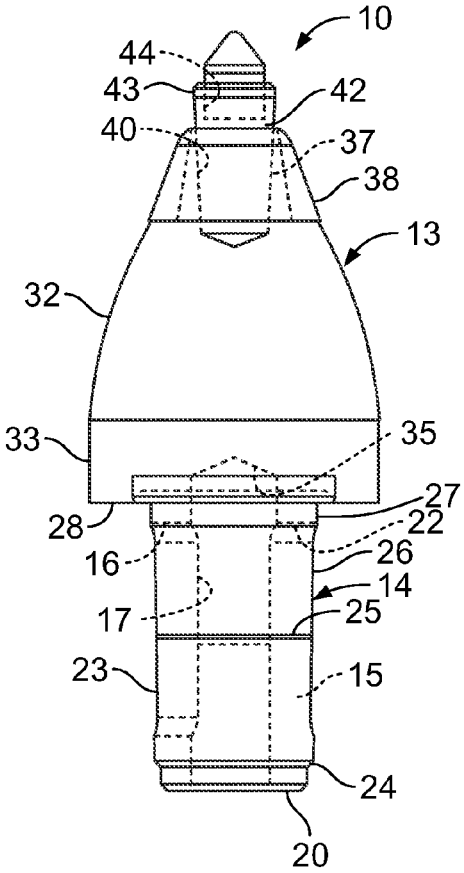
FIG. 3 is a side elevational view of the combination bit and bit holder shown in FIG. 1.
Figure 4:
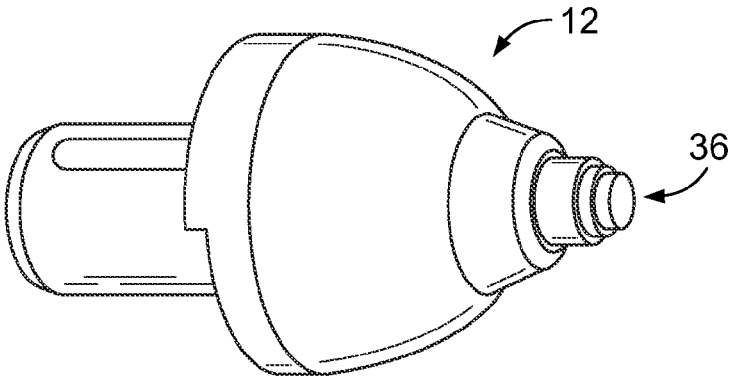
FIG. 4 is a front ¼ elevational perspective view of a modification of the first embodiment of a combination bit and bit holder showing a flat top cylindrical polycrystalline diamond tip and constructed in accordance with the present invention.

Referring to FIGS. 1-6, a first embodiment 10 and a first modification of the present invention are shown in perspective view in FIGS. 1 and 4, respectively. The invention resides in a unitary bit and bit holder construction that includes a bit holder base 13, generally constructed in accordance with the teachings of U.S. Pat. No. 6,585,326 and having a generally cylindrical hollow shank 14 which in this embodiment on one side thereof has an elongate slot 15 extending from the generally annular distal end of the shank axially upward or forward to a position 16 adjacent the upper or forward end of the shank. In this embodiment, the shank also includes a second internally oriented slot 17 180 degrees around the annular shank from the first slot. This second slot, first disclosed in U.S. Pat. No. 6,685,273, is parallel to the first slot and is an internal slot having a rearward semicircular termination 18 inwardly adjacent the distal end 20 of the shank 14 and a forward semicircular termination 22 generally coinciding longitudinally and axially with the upper termination 16 of the first slot 15.

In this first embodiment, the shank 14 preferably includes a lower or first tapered portion 23 running axially from a stepped shoulder 24 adjacent the distal end of the shank upwardly or axially from the top or front of the shank where it terminates generally mid slot longitudinally, and includes an annular shoulder 25 separating this lower portion from an upper or second tapered portion 26 which extends from that shoulder generally to the top of the shank or forward terminations of the slots. From a position adjacent the top or upper termination of the slots, a generally cylindrical upper portion 27 of the shank extends towards a generally annular back flange 28 denoting the base of the upper body 13 of the bit holder 10.

In the preferred first embodiment 10, this generally annular base includes a pair of horizontal slots 30-30 generally perpendicular to the longitudinal axis of the combination bit/bit holder, one on either side of the generally annular base 13 into which bifurcated fork tines may be inserted between the base of the body portion of the bit holder and a bit block (not shown) into which the shank of the bit/bit holder combination is inserted and retained by outward radial force in use.

The enlarged upper body 32 of the bit holder portion of the bit/bit holder combination 10 includes a generally cylindrical base 33 termed in the trade as a tire portion having a cylindrical side wall extending upwardly approximately ½ inch to a generally frustoconical, but in this embodiment a convex surfaced upper portion 32 which is a solid structure.

In this first preferred embodiment, a central bore 34 longitudinally and axially through the shank of the bit holder portion of the bit/bit holder combination terminates 35 approximately at the upper end of the shank 14. This allows the generally C-shaped annular side wall of the shank 14 to radially contract when the shank is mounted in one of a tapered or cylindrical bore in a bit block (not shown).

In this first preferred embodiment, the solid upper body 13 of the bit/bit holder combination provides added bulk and strength to the entire unitary assembly which allows the bit/bit holder combination 10 of the present invention to withstand substantial forces and stress superior to heretofore known bit holders or bit/bit holder combinations. The present invention may be utilized not only in the degrading and removal of macadam or asphalt from long straight stretches of roadway, but may also provide for the removal of concrete and other materials both in straight long stretches and in curved sections such as at corners, cloverleaf intersections, or the like. Also the flat top design 36 is less expensive to make and is a readily available part stocked by many suppliers.

Adjacent the top of the preferred first embodiment of the present invention shown in FIGS. 1-6, the generally convex sided bit holder body 13 has a generally flat annular flange 36 therearound positioned perpendicular to the axis of the bit holder from the interior of which axially extends a smaller radially oriented annular tapered upper or forward extension 37. Around this tapered upper extension 37 is fitted an annular tungsten carbide ring 38 which may preferably be braised into unitary construction with the remainder of the bit holder. The top or forwardmost portion of the tungsten carbide ring 38 and the annular tapered extension 37 of the upper body portion terminate generally at the top of the bit holder portion 32 of the combination bit/bit holder.

With the bit holder portion 13 of the present invention preferably made of 4340 or equivalent steel, the top of the forward extension 37 of the upper body 32 includes a generally radially declining tapered bore 40 extending from the co-terminal upper wall of the body axially inwardly thereof which defines a declining radial taper. This tapered bore 40 extends a short distance longitudinally axially inwardly of the annular flange 37 that defines the base for the tungsten carbide protective ring 38.

This declining taper bore provides a space for receiving a complementary shaped positive declining tapered outer surface of a solid steel base 42 of the bit for the bit/bit holder combination. The base of the bit also extends upwardly and outwardly axially longitudinally from the co-terminal top 37 of the bit holder body 13 and includes an upper annular ring portion 43 which in this embodiment is made of tungsten carbide.

This top portion of the bit base includes a generally cylindrical bore 44 positioned centrally therein into which the base 45 of the bit tip may be positioned and braised therein to provide a unitary structure. This base may be made of steel or tungsten carbide and includes at the outer or upper end thereof a tip 46 which is preferably made of polycrystalline diamond structure which, in this embodiment, may be frustoconical in shape as shown in FIGS. 1-3, or a flat generally cylindrical puck shape 32 as shown in the first modification of FIG. 4-6.

The conical tip 45 shown in FIGS. 1-3 is of the type which has been used in degrading straight long stretches of asphalt or macadam, and which is sufficiently brittle not to be used in more strenuous applications such as degrading concrete and degrading curved sections of highway surface construction.

Figure 5:
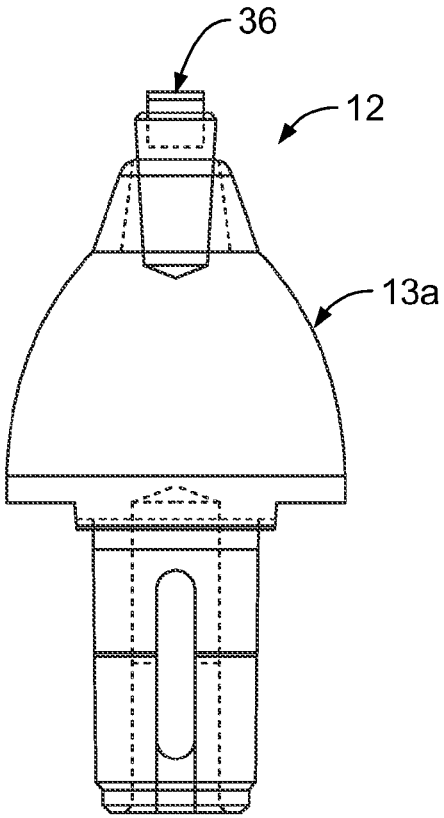
FIG. 5 is a front elevational view of the modification of the first embodiment of the combination bit and bit holder shown in FIG. 4.
Figure 6:
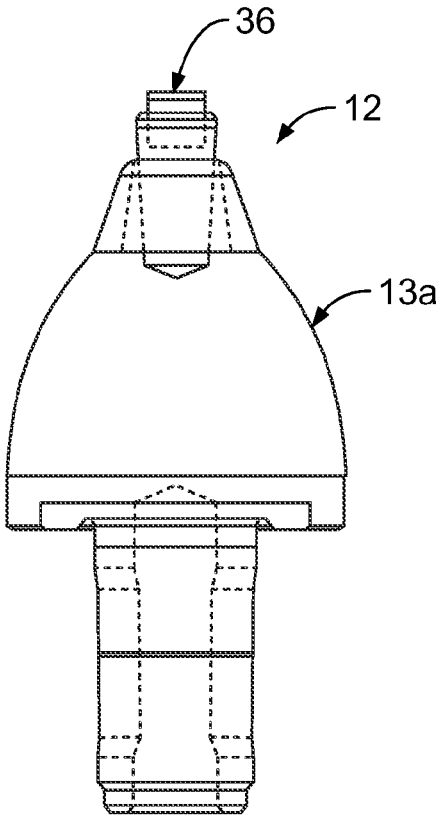
FIG. 6 is a side elevational view of the modification of the first embodiment of the combination bit and bit holder shown in FIG. 4.

The generally flat puck shaped tip 36 of the bit of the first modification 12 shown in FIGS. 4-6 provides a substantially stronger tip that is able to withstand the added forces and peak jolts found in degrading concrete and the like, and together with the added bulk of the body portion 13*a* of the preferred bit/bit holder combination is capable of removing or degrading concrete surfaces with the added life expectancy shown in prior bit/bit holder constructions with PCD tips that have heretofore been utilized only in removing long straight stretches of macadam. The steel member 13*a* holding the puck is an impact absorbing member that can stretch and compress without fracturing. A road milling machine can travel faster with forward speed using the instant bit/bit holders than it can with bit holders having a strictly tungsten carbide forward end. The remainder of the first modification is identical to the first embodiment.

In the second embodiment 50 of the preferred invention shown in FIGS. 7*a*, 7*b*, 8*a* and 8*b*, a bit 51, tip 52 and bit holder body portion 53 is similar to that shown in FIGS. 4-6. The shank 54 of the bit/bit holder combination provides an important aspect the present invention. In the second embodiment 50, the outer surface of the side wall 54*a* of the shank 54 is substantially similar to that shown in FIGS. 1-6, with the exception that the distal first tapered portion 55 of the shank includes three evenly space slots 56, 57, 58 longitudinally formed axially through the side wall 54*a*. It should be noted that the first tapered portion 55 may be constructed with either a slight taper of one degree or down to a cylindrical (no-taper) configuration. The second embodiment may include more or fewer slots.

In this second embodiment, not only is the generally frustoconical, convex side wall upper body 53 solid in construction with the exception of the bore 56 for mounting the bit 51 at the forward end 57 thereof, the shank that extends from the annular base 58 of the body portion 53 is also largely solid in construction. Similarly to the prior embodiment 10, the upper or forward portion of the shank 54*a* adjacent the annular flange base 58 of the body portion includes a cylindrical portion which has a second tapered portion 60 extending axially from the border thereof and a shoulder portion 61 that extends radially outwardly of the base of the second tapered portion that defines the top of the first tapered portion 62 which extends axially to the distal end 63 of the shank.

As indicated previously, this first tapered portion 62 may include a taper of about 1 degree or less down to having a cylindrical outer surface. Whereas the shank in the first embodiment shown in FIGS. 1-6 was hollow at its center, the shank of the second embodiment is solid at its center 64 completely from the body portion to the distal end of the shank. The first tapered portion 62 which in this embodiment includes three equally spatially circumferentially related longitudinal slots, defines a generally annular ring with the exception of the equally spaced slots 65, 66, 67. This slightly radially inwardly deformable first tapered portion 62 has an inner annular surface 68 defined by a trepanned or hole saw type bore 70 extending inwardly of the shank from the distal end 63 to the top of the first tapered portion 61. The depth of the trepanned groove 70 may be varied to obtain the proper preformability of the sidewall and the number of slots may be varied depending on the design parameters desired.

This annular trepanned groove 70 is formed to provide a side wall for the first tapered portion having a thickness which may vary from about ⅛ inch to about ½ inch depending upon the desired elastic flexibility of the side wall of the first tapered portion 62.

In construction, the trepanned groove 70 is a less expensive forming operation than is the bore 17 found in the first embodiment 10 of FIGS. 1-6, although the center portion of the shank may be removed if desired. Additionally, the trepanned groove 70 leaves the central core 71 of the shank 54 intact in the preferred second embodiment to provide a stronger overall construction for the combination bit/bit holder 50. Further, with the additional mass of the bit holder portion of the bit/bit holder combination, the entire bit holder may be made of less expensive steel than is necessary for the first embodiment 50 shown in FIGS. 1-6. Generally, steels of the type 4140 may be utilized for construction of the second embodiment of the present invention.

Figure 8B:
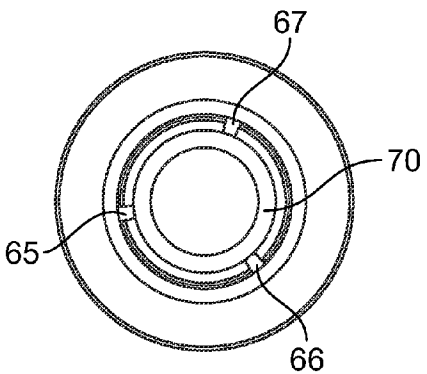
FIG. 8*b* is a bottom plan view of the second embodiment shown in FIG. 8.
Figure 8A:
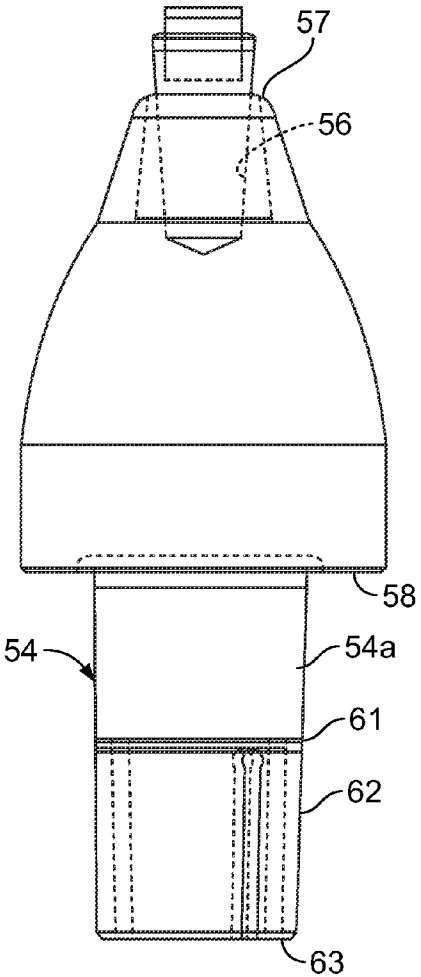
FIG. 8*a* is a side elevational view of the second embodiment of the present invention shown in FIGS. 7*a* and 7*b;*
Figure 7A:
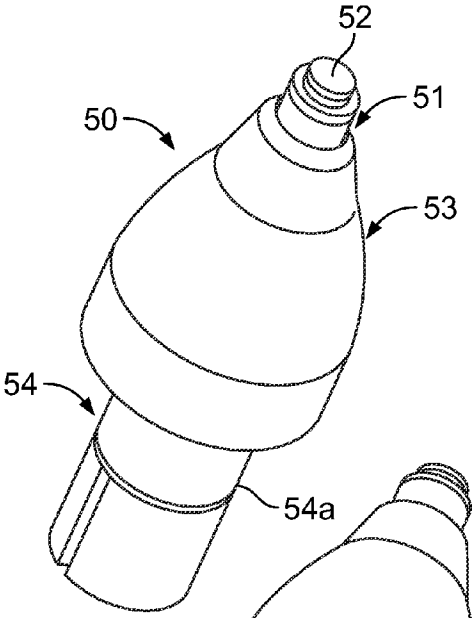
FIG. 7*a* is a ¾ top perspective view of a second embodiment of the combination bit and bit holder constructed in accordance with the present invention showing a trepanned shank distal end having 3 longitudinal spaced slots therein.
Figure 7B:
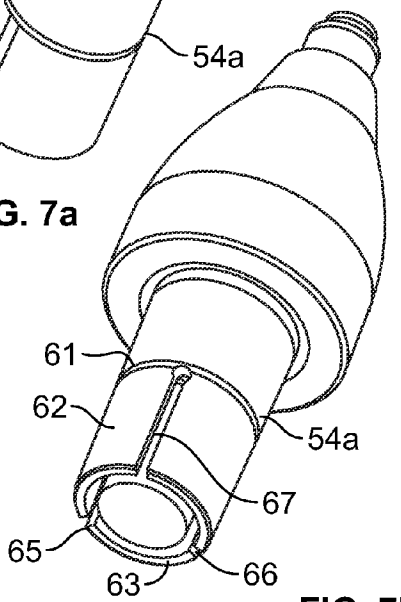
FIG. 7*b* is a ¾ bottom perspective view of the second embodiment of the present invention showing the longitudinally slotted trepanned shank thereon.

FIG. 8*a* shows the third embodiment 70 of the present invention which has its combined bit 71 and upper body 72 of the holder portion being identical to that shown in FIGS. 7*a*, 7*b*, 8*a* and 8*b*. The difference between the third embodiment 70 and the second embodiment 50 is in the trepanned first tapered portion of the shank 73, and slots shown in the second embodiment. Similarly to the second embodiment 50, the third embodiment 70 includes an annular trepanned groove 74 that extends axially inwardly in the first tapered portion 75 of the distal end 76 of the shank from the distal end generally to the shoulder at the top 77 of the first tapered portion.

Figure 9A:
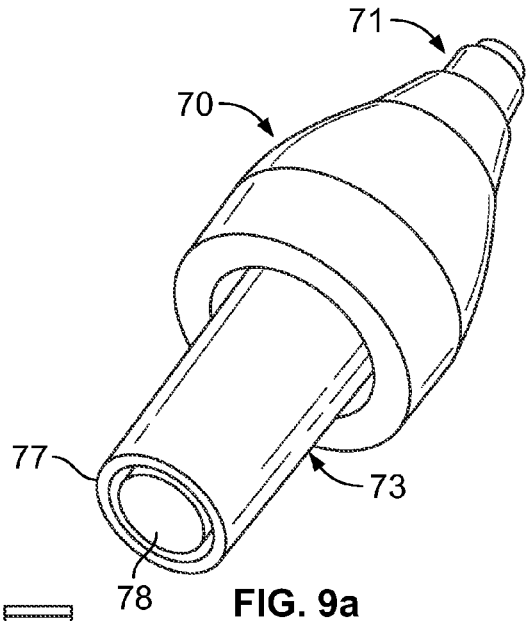
FIG. 9*a* is a bottom ¾ perspective view of a third embodiment of the present invention showing a trepanned shank constructed in accordance with the present invention.
Figure 9B:
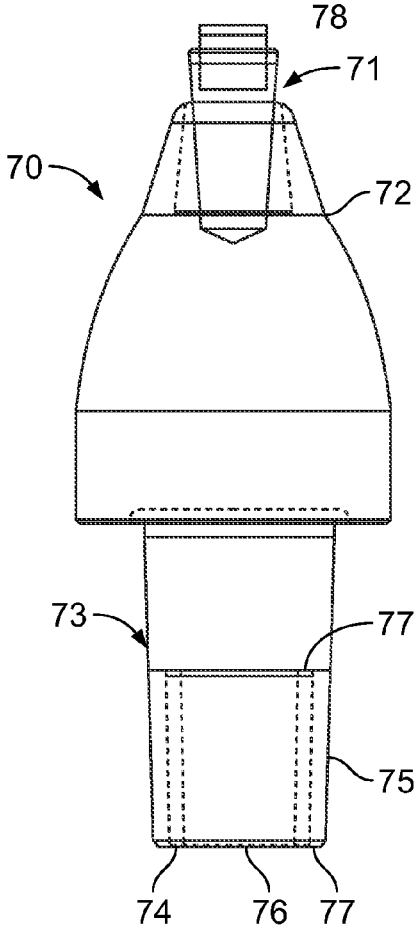
FIG. 9*b* is a side elevational view of the third embodiment of the present invention shown in FIG. 9*a;*

The difference between the second embodiment and the third embodiment is that the third embodiment does not include the slots shown in the second embodiment. The thickness of the outer side wall of the annular first tapered portion 75 (which may also be cylindrical) will be thinner than that disclosed in the second embodiment 50 shown in FIGS. 7*a*, 7*b*, 8*a* and 8*b* and may be on the order of 1/16 to ¼ inch wall thickness for the embodiment shown in FIGS. 9*a* and 9*b*, having a nominal 1½ inch outer diameter. As a result, while the typical interference fit for severe or extreme uses such as concrete degradation might have a solid shank interference of 0.001 to 0.003 of an inch thickness for the nominal 1½ inch diameter shank, the interference fit for the thin side wall in the trepanned outer portion 77 of the shank in the third embodiment 70 would approximate two to four times the previously mentioned interference fit.

With such a fit, the shank side wall may wrinkle when a shank is inserted in a bit block bore. Again, the third embodiment 70 shown in FIGS. 9*a* and 9*b* would be less expensive to manufacture than even the second embodiment 50 shown in FIGS. 7*a*, 7*b*, 8*a* and 8*b*. In this third embodiment 70, the core or central portion 78 of the shank may be left intact, or removed, and the combination of that mass in the shank together with the solid upper body and integrally formed bit 71 braised thereon provides a structure which can be utilized to degrade not only macadam or asphalt but also concrete pavement.

The use of the flat puck shaped polycrystalline bit tip, the bit/bit holder combination provides added use life for the structure and sturdiness thereof which would be superior to the bit and bit holder combinations heretofore known. The shorter use life for a tungsten carbide tipped bit has resulted in a design necessity of allowing the bit to be removed and replaced numerous times prior to replacing the bit holder.

Figure 10:
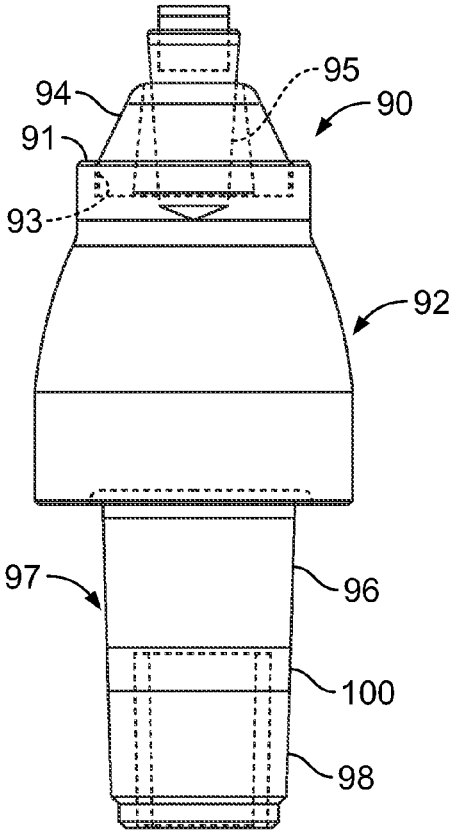
FIG. 10 is a side elevational view of a fourth embodiment of the present invention.

Referring to FIG. 10, a fourth embodiment 90 of the present invention is similar to the prior embodiments disclosed herein with 2 differences. First, in order to provide superior brazing of the tungsten carbide ring to the forward end of the bit holder, a forwardly extending annular collar 91 is created on the bit holder 92 to provide an annular trough 93 onto which the annular ring 94 is mounted. The vertical outer wall of the trough will keep brazing material from flowing outwardly of the joinder between the base of the ring and the annular flange on which the ring is positioned. After the brazing is complete, the outer portion of the trough may be left as is, or may be removed and generally conformed to a shape similar to that shown in FIGS. 1-6.

The second difference between the fourth embodiment and the preceding one is an annular cylindrical outer wall portion 96 adjacent the top of the first tapered portion of the shank 97. When it has been determined that the design parameters for the outward forces at the shank first tapered portion 98 have been met utilizing less than the whole available surface area, an annular cylindrical area 100 may be formed adjacent the upper end of the first tapered portion that keeps that area from contacting the bit block bore. The axial width of the cylindrical band may be varied to meet design criteria.

While the invention herein has been shown in three embodiments, and a modification of the first embodiment, it will be understood by those skilled in the art that changes and modifications may be made within the aspect of the present invention without departing from the true spirit and scope of the present invention. It is the intent of the appended claims to cover all such changes and modifications which fall within the true spirit and scope of the invention.

What is claimed:

1. A bit/bit holder for road milling machinery comprising:

a body of rounded shape having an upper end diametrically smaller than a lower end thereof, said body being solid in a substantial portion thereof, a generally cylindrical shank extending from said lower end of said body, said shank being hollow and including at least one axially oriented elongate slot through a side wall of said shank, said upper end of said body including a bore extending axially therein, an insert retained in said bore forming a unitary structure with said body, said insert including a polycrystalline coated distal tip said bore extending axially in said upper end of said body includes an annular declining taper side wall, said insert having a complementary declining taper side wall for matingly fitting therein, a top of said insert extending outwardly of said bore in said upper end of said body and including a central cylindrical bore therein, and a PCD coated bit receivingly retained in said central bore.

2. The bit/bit holder as defined in claim 1 wherein said PCD coated bit has a flat top surface.

3. The bit/bit holder as defined in claim 1 wherein said PCD coated bit has a generally conical top surface.

4. The bit/bit holder as defined in claim 1 wherein said insert includes an annular tungsten carbide ring surrounding said bore.

5. The bit/bit holder as defined in claim 1 wherein said insert is made of steel having a ductility to provide an impact absorbing member adjacent said PCD coated tip.

6. The bit/bit holder as defined in claim 1 wherein said upper end of said body further includes an annular generally frustoconical ring of tungsten carbide surrounding the outside thereof.

* * * * *